US007619402B1

(12) United States Patent
Kwong

(10) Patent No.: US 7,619,402 B1
(45) Date of Patent: Nov. 17, 2009

(54) LOW DROPOUT VOLTAGE REGULATOR WITH PROGRAMMABLE ON-CHIP OUTPUT VOLTAGE FOR MIXED SIGNAL EMBEDDED APPLICATIONS

(75) Inventor: Kwok Kuen David Kwong, Davis, CA (US)

(73) Assignee: Hong Kong Applied Science and Technology Research Institute Co., Ltd., Hong Kong (HK)

( * ) Notice: Subject to any disclaimer, the term of this patent is extended or adjusted under 35 U.S.C. 154(b) by 0 days.

(21) Appl. No.: 12/239,303

(22) Filed: Sep. 26, 2008

(51) Int. Cl.
*G05F 1/12* (2006.01)

(52) U.S. Cl. ..... 323/369; 323/297

(58) Field of Classification Search ..... 323/364, 323/367, 369, 297
See application file for complete search history.

(56) References Cited

U.S. PATENT DOCUMENTS 3,612,220 A * 10/1971 Hall et al. ..... 187/295
6,005,374 A 12/1999 Tasdighi
6,949,971 B2 9/2005 Jang
7,205,827 B2 4/2007 Leung et al.

* cited by examiner

*Primary Examiner*—Shawn Riley
(74) *Attorney, Agent, or Firm*—Stuart T. Auvinen; gPatent LLC

(57) ABSTRACT

A programmable voltage generator has software-programmable registers that may be decoded to generate control bits that turn on select transistors that control a variable resistor network. An external power voltage is input to a regulator transistor, which has a channel resistance controlled by a gate voltage. The channel resistance of the regulator transistor produces a regulated voltage as an output. An op amp compares a reference voltage to a feedback voltage to generate the gate voltage. The feedback voltage is taken from a tap within the variable resistor network. The variable resistor network has select transistors that select one resistor between the regulated voltage and an upper node, and that select one resistor between a lower node and ground. Switches select a tap within a series of resistors between the upper and lower nodes. Y (fine) control bits select the tap while X (coarse) control bits enable select transistors.

22 Claims, 8 Drawing Sheets

| | Vout (2.7) | Vout (3.0) | Vout (3.3) | Vout (3.6) |
|---|---|---|---|---|
| ay0 | 2.590 | 2.850 | 3.130 | 3.384 |
| ay1 | 2.618 | 2.889 | 3.172 | 3.433 |
| ay2 | 2.648 | 2.925 | 3.215 | 3.484 |
| ay3 | 2.678 | 2.962 | 3.260 | 3.537 |
| ay4 | 2.700 | 3.000 | 3.306 | 3.591 |
| ay5 | 2.741 | 3.039 | 3.354 | 3.647 |
| ay6 | 2.773 | 3.078 | 3.402 | 3.705 |
| ay7 | 2.807 | 3.119 | 3.452 | 3.764 |
| | ax0 | ax1 | ax2 | ax3 |

FIG. 5

LOW DROPOUT VOLTAGE REGULATOR WITH PROGRAMMABLE ON-CHIP OUTPUT VOLTAGE FOR MIXED SIGNAL EMBEDDED APPLICATIONS

FIELD OF THE INVENTION

This invention relates to voltage regulators, and more particularly to programmable voltage regulators.

BACKGROUND OF THE INVENTION

Semiconductor processing improvements have increased the density and number of transistors and other devices that can be integrated together onto a single silicon integrated circuit die. These large systems-on-a-chip (SoC) often include some analog functions as well as many digital functions. However, the digital systems can be noisy as digital circuits switch between high and low states. Since analog circuits have a theoretically infinite number of states or voltage levels, while digital has just two states, analog systems are inherently more sensitive to noise.

Traditionally, analog systems were segregated from digital systems. However, with higher levels of integration and single-chip systems, analog systems must share a silicon substrate with noisy digital systems. Typically separate power supplies are used for digital and analog circuits on the same chip. The analog power supply, AVDD, is separate from the digital power supply VDD on the mixed-signal chip. The power-supply voltage levels for AVDD and VDD may be different, and AVDD is carefully designed to be as noise-free as possible.

A low-dropout (LDO) voltage regulator may be used to generate AVDD from VDD. Traditionally, LDO voltage regulators were external to the mixed-signal chip, allowing for better noise isolation. Also, the exact AVDD voltage level could be determined by a ratio of precision resistors. The precision resistors could be discrete external resistors, or could be trimmed during manufacture, such as by a laser trimming a resistor line, or by fuses. The voltage regulator could be on-chip, with the precision resistors off-chip.

Such trimming of resistors or blowing of fuses could be done on a larger SoC that includes the voltage regulator, but adding fuses to the process, or adding the step of laser trimming can significantly increase manufacturing costs and is thus undesirable. Once the resistance values are chosen, they may be irreversible as there may be no way to add back portions of a laser-trimmed resistor or to re-connect a blown fuse.

What is desired is a low-dropout voltage regulator that is integrated with analog and digital functions on a mixed-signal SoC. A LDO voltage regulator that has an adjustable output voltage by adjusting resistance values is desirable. An on-chip voltage regulator with software-programmable resistance values is desirable. Interpolation of adjacent resistance values is desirable to more precisely define resistance and output-voltage values. A high-precision user-programmable on-chip voltage regulator is desirable.

BRIEF DESCRIPTION OF THE DRAWINGS

FIG. 5 is a table showing control signal encodings and the resulting Vout voltages produced.

DETAILED DESCRIPTION

The present invention relates to an improvement in programmable voltage regulators. The following description is presented to enable one of ordinary skill in the art to make and use the invention as provided in the context of a particular application and its requirements. Various modifications to the preferred embodiment will be apparent to those with skill in the art, and the general principles defined herein may be applied to other embodiments. Therefore, the present invention is not intended to be limited to the particular embodiments shown and described, but is to be accorded the widest scope consistent with the principles and novel features herein disclosed.

Figure 1:
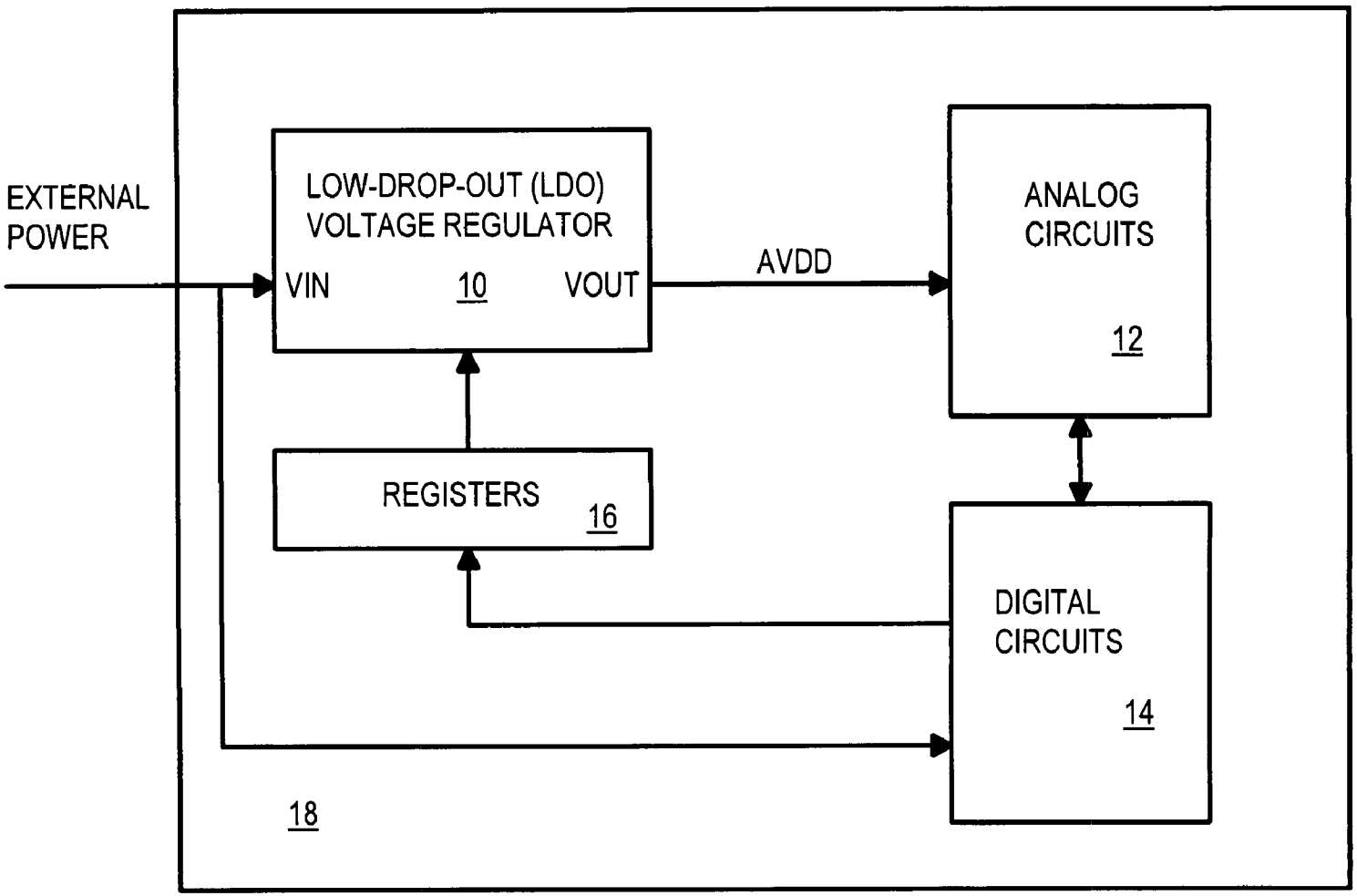
FIG. 1 is a block diagram of a mixed-signal system-on-a-chip (SoC) with an integrated voltage regulator controlled by software-programmable registers.

FIG. 1 is a block diagram of a mixed-signal system-on-a-chip (SoC) with an integrated voltage regulator controlled by software-programmable registers. Chip 18 has digital circuits 14 that are powered by external power and analog circuits 12 that are powered by one or more internal power supplies AVDD. A separate voltage regulator or external input (not shown) could be used for the internal VDD power supply to digital circuits 14.

External power is applied to chip 18 and routed to Vin of voltage regulator 10. External power could be from an external power supply that generates a 5-volt or 3-volt power voltage or some other voltage. One or more external ground pins (not shown) connect to one or more internal ground buses to sink currents in analog circuits 12 and digital circuits 14. Voltage regulator 10 and registers 16 may also connect to an internal ground bus.

Voltage regulator 10 compares Vin to its Vout, which is AVDD, to regulate AVDD. Variations on AVDD due to temperature, loading, or other factors can be detected by this comparison and compensated for by voltage regulator 10.

Voltage regulator 10 has a precise voltage generator such as a bandgap voltage regulator and compares this reference voltage to a feedback voltage. The feedback voltage is divided from Vout (AVDD) using on-chip resistors. The exact values of these on-chip resistors are programmable. Registers 16 are programmed through digital circuits 14, such as by a user, software, driver, operating system or Basic Input Output System (BIOS) programming values into register 16. For example, during manufacturing test, different values can be programmed into registers 16 until the desired value is obtained that produce the target value of AVDD.

Figure 2:
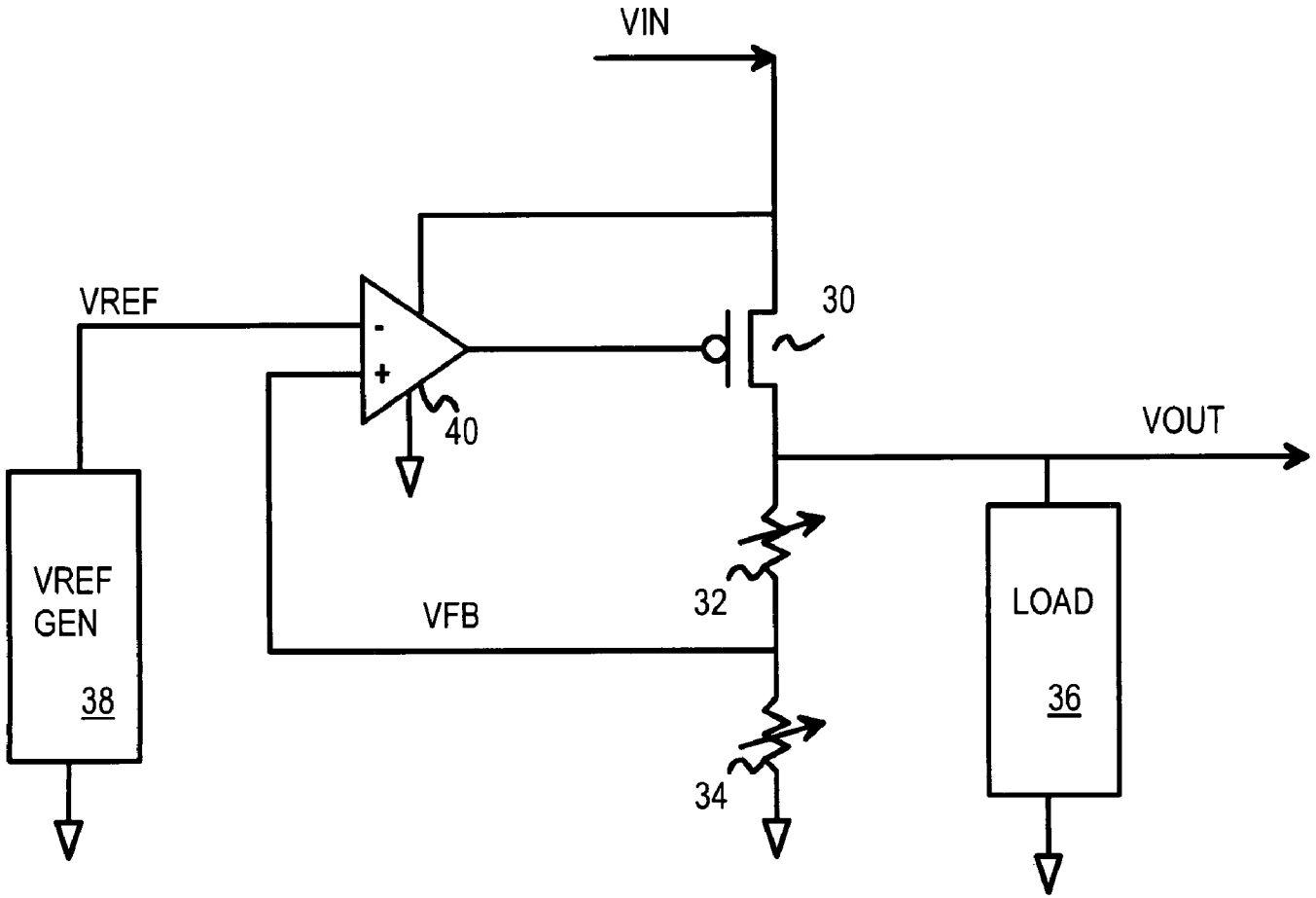
FIG. 2 shows an on-chip programmable voltage regulator.

FIG. 2 shows an on-chip programmable voltage regulator. Voltage regulator 10 of FIG. 1 can be implemented in this way where the values of variable resistors 32, 34 are controlled by values programmed into registers 16 of FIG. 1. Load 36 on Vout is the loading on AVDD by analog circuits 12.

An external power-supply voltage Vin is applied to the source of p-channel regulator transistor 30 and also powers op amp 40. The well or substrate terminal (not shown) of regulator transistor 30 is also connected to Vin. The drain of regulator transistor 30 is regulated voltage Vout, which can be the analog supply AVDD (FIG. 1).

Op amp 40 compares its inputs and generates an output voltage as a function of the voltage difference on its inputs. The output voltage from op amp 40 drives the gate of regulator transistor 30. The gate-to-source voltage Vgs of regulator transistor 30 is varied to vary the effective source-to-drain resistance of regulator transistor 30, which determines Vout. Regulator transistor 30 operates primarily in the linear region rather than in the saturated region, depending on Vin and Vout.

Voltage generator 38 is a bandgap or other precision on-chip voltage regulator that generates a reference voltage Vref that is applied to the inverting (−) input of op amp 40. The non-inverting (+) input of op amp 40 receives a feedback voltage Vfb that is a divided voltage from Vout. Vfb is the midpoint node between variable resistors 32, 34 connected in series between Vout and ground.

As Vout rises, Vfb also rises. When Vfb rises above Vref, op amp 40 increases the gate voltage on regulator transistor 30, which reduces the absolute value of Vgs, reducing the current drive and increasing the channel resistance of regulator transistor 30. The higher resistance of regulator transistor 30 lowers Vout, compensating for the rise in Vout that initiated the feedback loop response. Thus feedback acts to regulate Vout. The value of Vout is set by Vref=Vfb, and Vfb is set by the ratio of variable resistors 32, 34. Thus:

$$Vout=Vref*(R32+R34)/R34$$

The precise values of variable resistors 32, 34 are set by programming registers 16 of FIG. 1. Ideally, the resistance values of variable resistors 32, 34 is set to within 1%.

Figure 3:
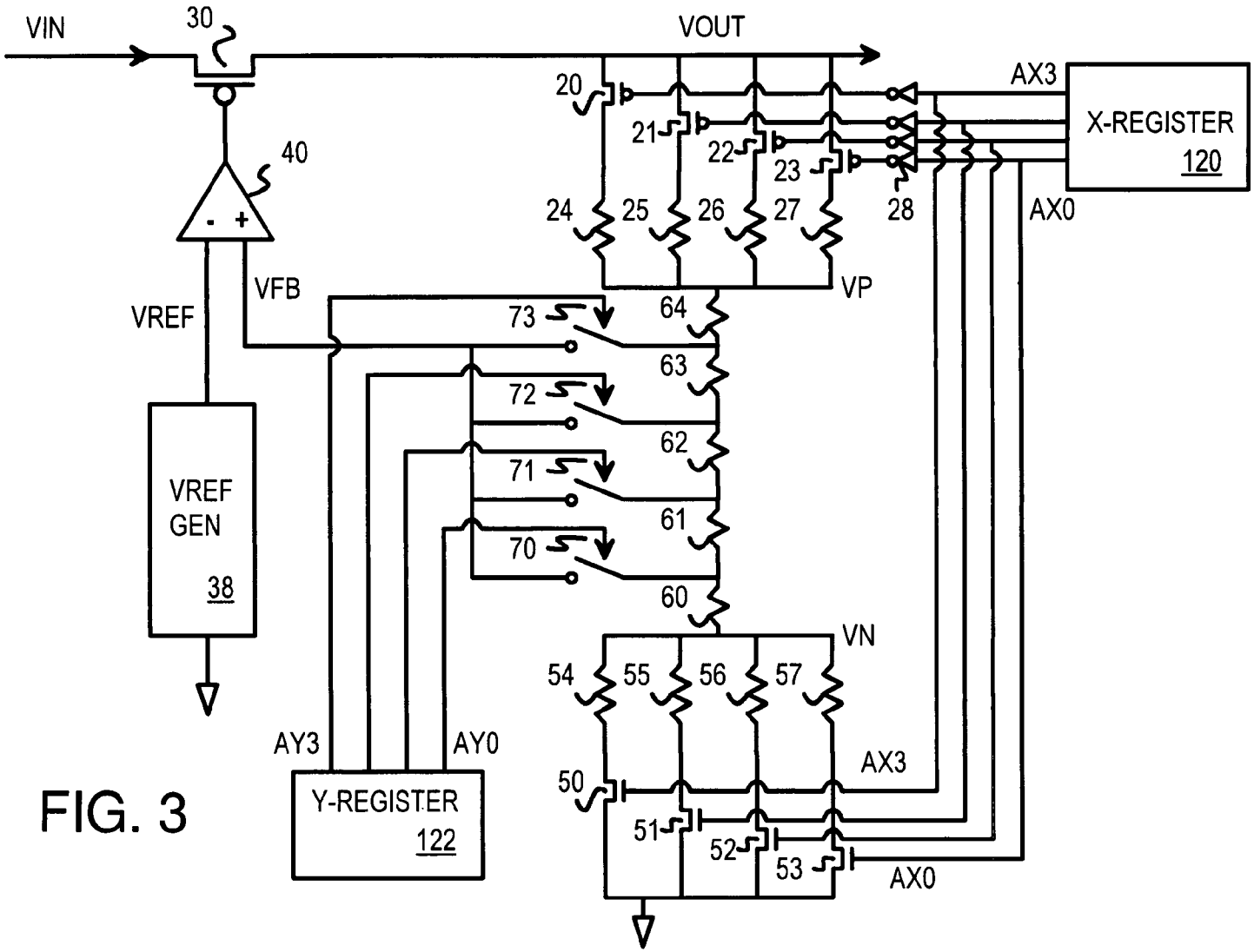
FIG. 3 is a more detailed diagram of a programmable voltage regulator.

FIG. 3 is a more detailed diagram of a programmable voltage regulator. The channel resistance of regulator transistor 30 between Vin and Vout is adjusted by its gate voltage generated by op amp 40. Reference voltage Vref generated by reference voltage generator 38 is compared to feedback voltage Vfb by op amp 40.

Feedback voltage Vfb is a divided voltage between Vout and ground. The precise resistance values between Vout and Vfb, and between Vfb and ground, are determined by X register 120 and Y register 122, which act as registers 16 of FIG. 1.

In the example shown in FIG. 3, four bits AY0:3 are stored in Y register 122. These four bits control switches 70, 71, 72, 73, respectively. Switches 70-73 can be n-channel transistors or full transmission gates with parallel n-channel and p-channel transistors and a gate inverter.

For example, when AY0 is 1 and AY1:3 are all 0, switch 70 is closed and switches 71, 72, 73 are open. Then feedback voltage Vfb is taken through switch 70 from between resistors 60, 61. When AY2 is 1 and AY0:1 and AY3 are all 0, switch 72 is closed and switches 70, 71, 73 are open. Then feedback voltage Vfb is taken through switch 70 from between resistors 62, 63. This setting of AY2=1 produces a higher Vfb and lower Vout than does the setting of AY0=1.

X register 120 has four bits AX3:0 which turn on one or more of n-channel select transistors 50, 51, 52, 53, respectively, to connect one or more of pull-down resistors 54, 55, 56, 57 to node VN. These four bits are inverted by inverters 28 to drive the gates of p-channel select transistors 20, 21, 22, 23, respectively, which connect resistors 24, 25, 26, 27 to node VP.

For example, when AX0=1 and AX1:3 are all zero, n-channel select transistor 53 turns on to connect resistor 57 between node VN and ground. Other select transistors 50, 51, 52 are turned off, so only resistor 57 conducts current from node VN to ground. P-channel select transistor 23 is turned on to connect resistor 27 between Vout and VP, while p-channel select transistors 20, 21, 22 are all off. Only resistor 27 conducts current between Vout and VP.

When Y register 122 has AY1=1 and other bits=0, only switch 71 is closed. Vfb is between resistors 61, 62. The total resistance between Vout and Vfb (variable resistor 32 of FIG. 2) is thus the sum of resistances of resistors 27, 64, 63, 62. The total resistance between Vfb and ground (variable resistor 34 of FIG. 2) is the sum of resistances of resistors 61, 60, 57.

Figure 4:
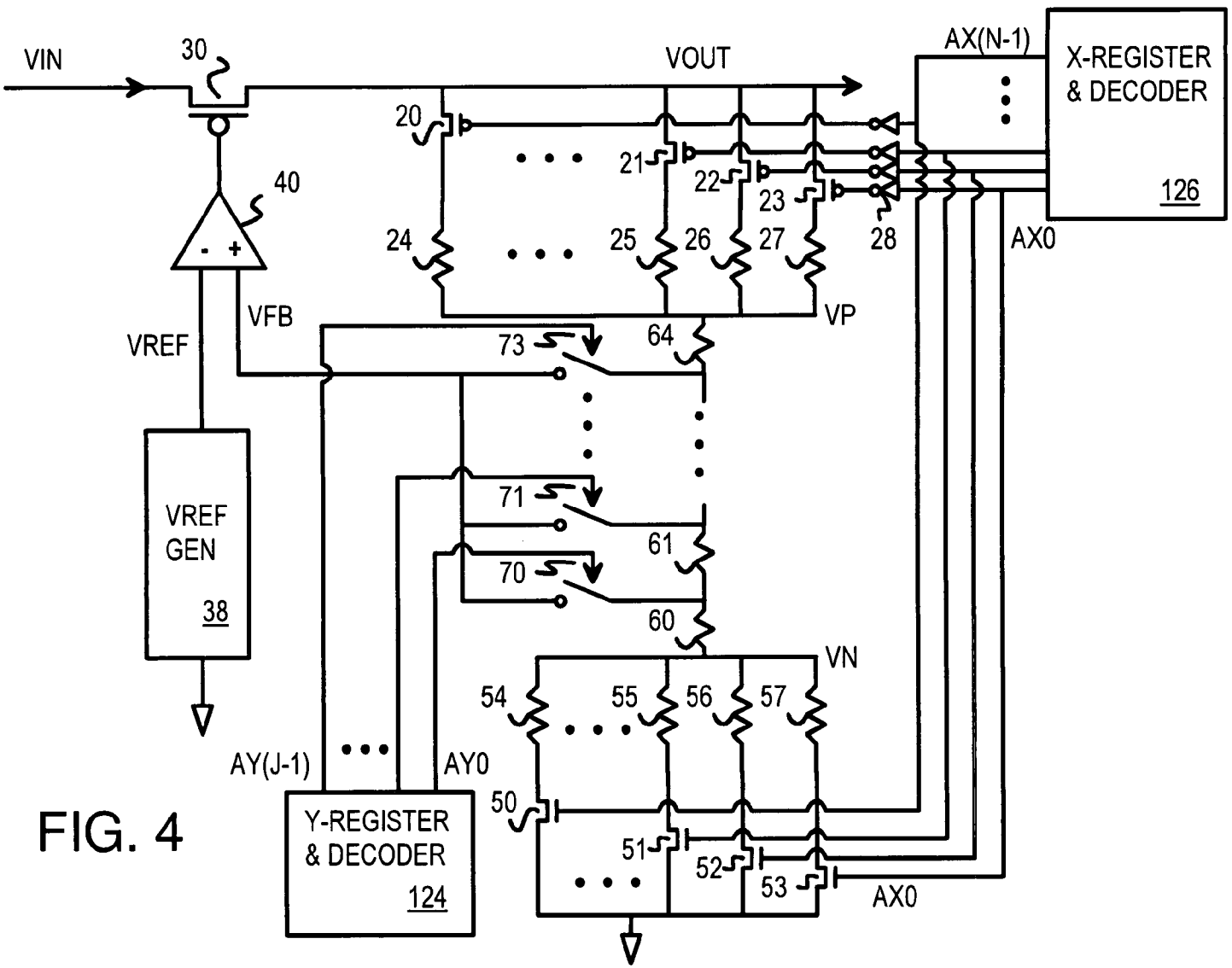
FIG. 4 shows a more generalized programmable voltage regulator.

FIG. 4 shows a more generalized programmable voltage regulator. The channel resistance of regulator transistor 30 between Vin and Vout is adjusted by its gate voltage generated by op amp 40. Reference voltage Vref generated by reference voltage generator 38 is compared to feedback voltage Vfb by op amp 40. Feedback voltage Vfb is a divided voltage between Vout and ground. The precise resistance values between Vout and Vfb, and between Vfb and ground, are determined by X register and decoder 126 and Y register and decoder 124, which act as registers 16 of FIG. 1.

X register and decoder 126 outputs N control signals AX0 . . . AX(N−2), AX(N−1) that control N p-channel select transistors 53, 52, 51, . . . 50 that selectively connect one or more of resistors 57, 56, 55, . . . 54 between node VN and ground. The N control signals AX0 . . . AX(N−2), AX(N−1) also control N n-channel select transistors 23, 22, 21, . . . 20 that selectively connect one or more of resistors 27, 26, 25, . . . 24 between Vout and node VP.

Select resistors 57, 56, 55, . . . 54 can each have a different value, such as 132K, 119K, 107K, 98K ohms, etc. Select resistors 27, 26, 25, . . . 24 can also each have a different value, such as 155K, 169K, 180K, 189K ohms, etc.

Y register and decoder 124 outputs J signals AY0 . . . AY(J−2), AY(J−1) that control J switches 70, 71, . . . 73 that selectively connects feedback node Vfb to one node within the series of resistors 60, 61, . . . 64. There are J+1 resistors 60, 61, . . . 64 between nodes VP and VN. These J+1 resistors 60, 61, . . . 64 can have equal values, such as each one being 1.6 K-ohms.

The total resistance of variable resistor 32 is the sum of all selected resistors in series between node Vfb and Vout, while the total resistance of variable resistor 34 is the sum of all selected resistors in series between node Vfb and ground. This assumes only one of the X control signals and only 1 of the Y control signals are active. When more than one X control signal is active, the total resistive can be found by the parallel combination of select resistors and the series resistors down to node Vfb. Kirchoff's laws or various equations may be used for finding the equivalent resistances of these more complex resistor networks.

For example, when AX0=1 and AY0=1, and all other control signals are 0, the resistance of variable resistor 32 between Vout and Vfb is the sum of resistors 27, 64, 63, 62, . . . 61, or 155K+1.6K*(J−1) ohms. The resistance of variable resistor 34 between Vfb and ground is the sum of resistor 57 and resistor 60, or 132K+1.6K ohms.

Y register and decoder 124 can have a decoder so that fewer register bits need to be stored to be decoded to J control signals. When only 1 of the control signals can be high at a time, $J=2^U$, where U is the number of register bits. For example, 3 register bits can be decoded to 8 control signals. X register and decoder 126 can also use encoded register bits in a similar manner.

FIG. 5 is a table showing control signal encodings and the resulting Vout voltages produced. The table shows an example where 8 control signals are output by Y register and decoder 124 and 4 control signals are output by X register and decoder 126. Vin is 5.5 volts and Vref is 1.25 volts in this simulation. X register and decoder 126 selects the coarse voltage, such as 2.7, 3.0, 3.3, or 3.6 volts for Vout, while Y register and decoder 124 performs finer-grained voltage selection. Each increment from one Y control signal to the next produces a voltage change of about 0.04 volt, while each increment in one X control signal produces a voltage change of about 0.30 volt. However, these increments vary somewhat with the final voltage Vout. The coarse adjustments are at least five times larger than the fine voltage adjustments in some embodiments.

Figure 6:
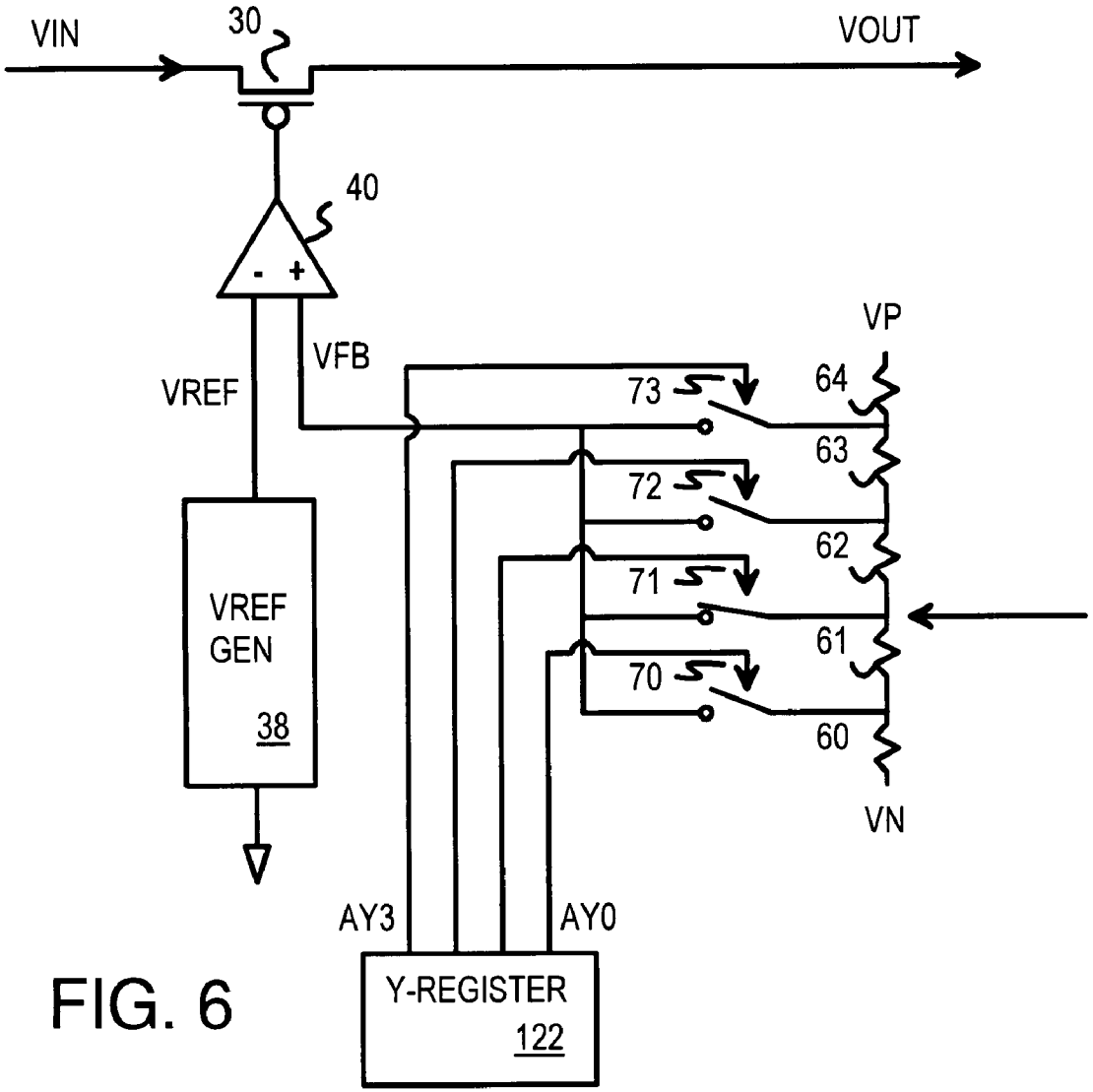
FIG. 6 highlights voltage interpolation when only one control signal is active at one same time.

FIG. 6 highlights voltage interpolation when only one control signal is active at one same time. Only 1 control signal may be active at one time when registers with decoders are used, such as Y register and decoder 124. For example, Y register and decoder 124 has bit AY1 high and AY0, AY2, and AY3 low. Switch 71 is closed, while switches 70, 72, 73 are open. Node Vfb is connected to the node between resistors 61, 62. The value of resistor 62 is included in the sum for variable resistor 32, while value of resistor 61 is included in the sum for variable resistor 34. The tap for Vfb is effectively taken from between resistors 61, 62 as the arrow shows.

Figure 7:
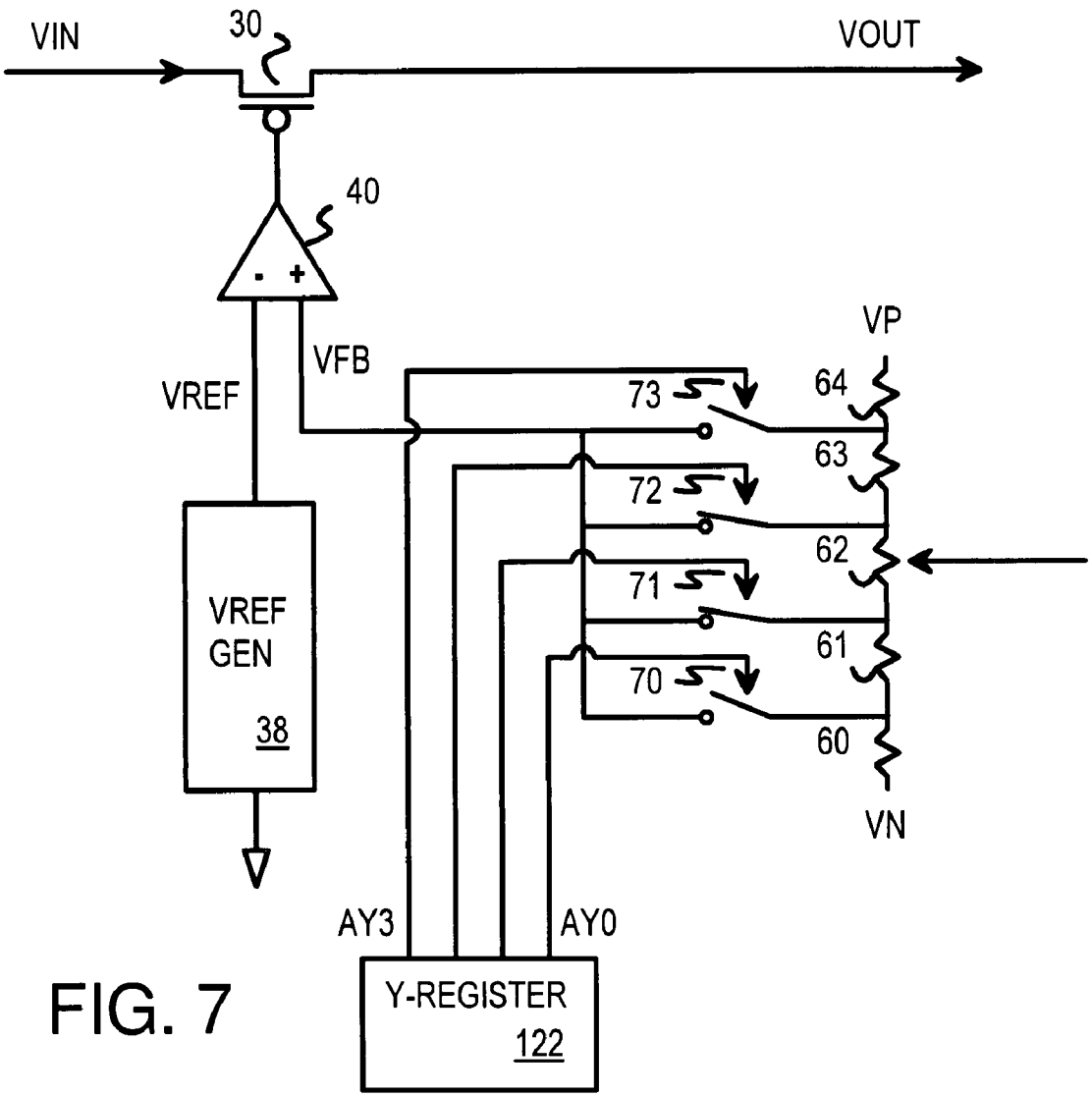
FIG. 7 highlights voltage interpolation when two control signals are active at a same time.

FIG. 7 highlights voltage interpolation when two control signals are active at a same time. More than 1 control signal may be active at one time when registers without decoders are used. For example, Y register 122 has bits AY1 and AY2 high and AY0 and AY3 low. Switches 71, 72 are both closed, while switches 70, 73 are open. Node Vfb is connected to both terminals of resistor 62. The value of resistor 62 is not included in the sums for either of variable resistor 32, 34.

The Vout produces is intermediate to what would be produced if only AY1 or only AY2 were selected. Thus an intermediate Vout is produced about midway between the two values produced by one-hot Y encoding when two adjacent Y values are active. This provides for higher voltage precision. The tap for Vfb is effectively taken from the middle of resistors 62 as the arrow shows.

Figure 8:
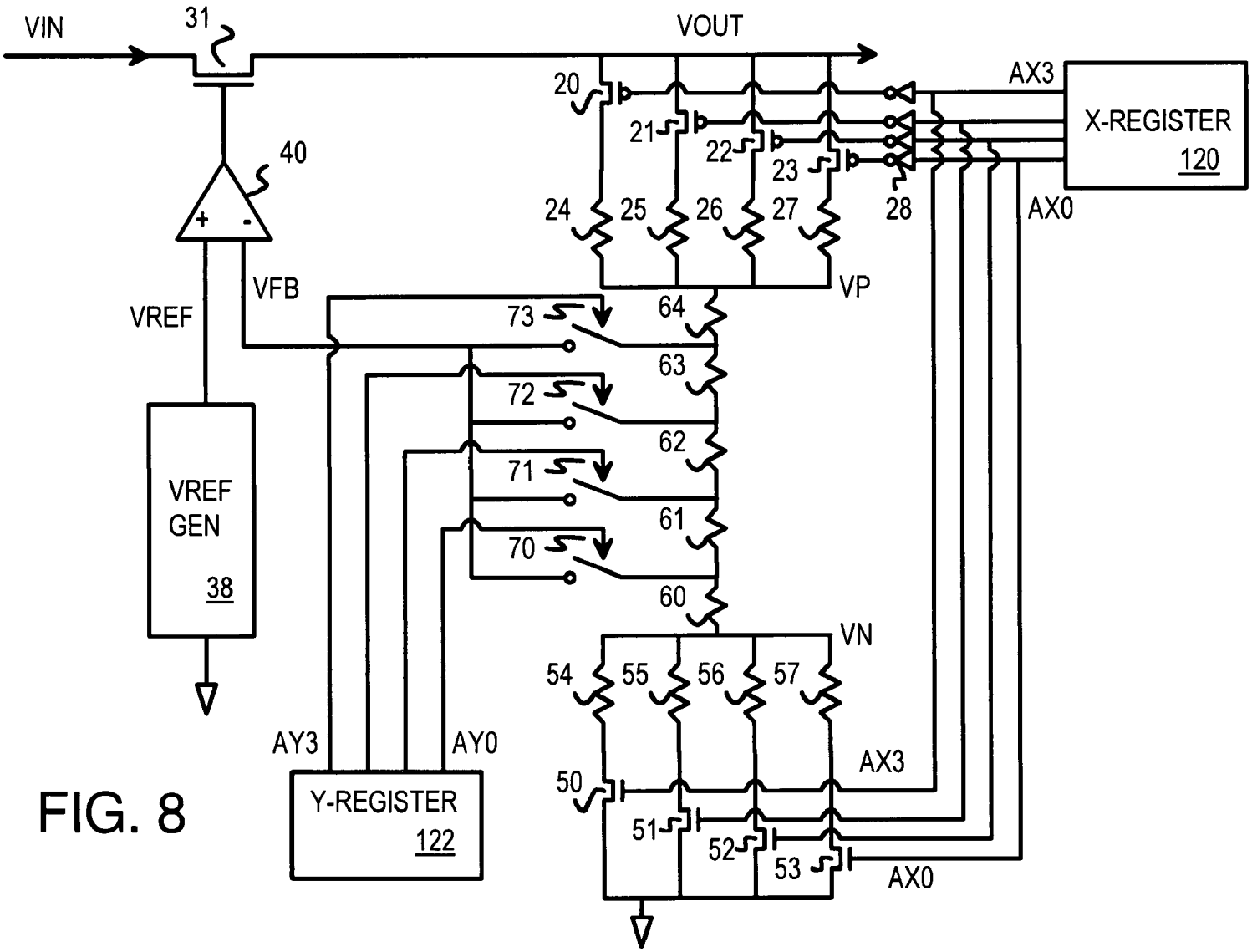
FIG. 8 is an alternate embodiment using a source-follower regulator transistor.

FIG. 8 is an alternate embodiment using a source-follower regulator transistor. FIG. 8 is similar to FIG. 3, except that p-channel regulator transistor 30 is replaced by n-channel regulator transistor 31. The inverting and non-inverting inputs of op amp 40 are also reversed to drive the gate of the n-channel transistor rather than a p-channel transistor gate.

The drain of n-channel regulator transistor 31 receives input voltage Vin, while the source is the output node generating Vout. N-channel regulator transistor 31 is a source follower.

As Vout rises, Vfb also rises. When Vfb rises above Vref, op amp 40 decreases the gate voltage on regulator transistor 31, which reduces the value of Vgs, reducing the current drive and increasing the channel resistance of n-channel regulator transistor 31. The higher resistance of regulator transistor 31 lowers Vout, compensating for the rise in Vout that initiated the feedback loop response. Thus feedback acts to regulate Vout. The value of Vout is set by Vref=Vfb, and Vfb is set by the ratio of variable resistors 32, 34 as described earlier.

ALTERNATE EMBODIMENTS

Several other embodiments are contemplated by the inventors. For example the resistance values of select and other resistors may vary in different patterns. Multiple control bits could be active at once, rather than just one-hot encoding, and several resistors could be enabled in parallel as well as in series. Capacitors and other filter elements may be added. Switches could be n-channel transistors, p-channel transistors, or transmission gates with parallel n-channel and p-channel transistors.

Additional components may be added at various nodes, such as resistors, capacitors, inductors, transistors, etc., and parasitic components may also be present. Enabling and disabling the circuit could be accomplished with additional transistors or in other ways. Pass-gate transistors or transmission gates could be added for isolation.

Inversions may be added, or extra buffering. The final sizes of transistors and capacitors may be selected after circuit simulation or field testing. Metal-mask options or other programmable components may be used to select the final capacitor, resistor, or transistor sizes.

When a p-channel (PMOS) output transistor is used for regulator transistor 30, a low-dropout (LDO) voltage regulator may be obtained with excellent frequency characteristics. Miller compensation may be provided or just using a coupling capacitor for pole compensation. Output and power-supply noise may be filtered out or otherwise compensated for. However, p-channel transistor tend to have lower current drive per unit size than n-channel transistors, so an NMOS source-follower may be desirable for some applications requiring higher current drive. While an operational amplifier (op amp) has been described, other kinds of comparators could be used, such as non-amplifying compare buffers. Many kinds of encodings could be used for the registers to reduce a number of bits stored, or fully decoded bits may be stored in the registers that correspond to the control bits. While separate X and Y registers have been shown, these could be one register, and one encoding could be decoded to generate control bits for both X and Y switches. De-glitching or other circuits could be added to prevent changes in register bits from propagating to the resistor network in a way that could cause glitches. Various combinations are also possible. The programmable registers may be implemented as flip-flops, latches, read-only memory (ROM), EEPROM, flash memory, SRAM, etc.

The circuit designer may choose the resistors to have a ratio that produces the desired reference voltages. While Complementary-Metal-Oxide-Semiconductor (CMOS) transistors have been described, other transistor technologies and variations may be substituted, and materials other than silicon may be used, such as Galium-Arsinide (GaAs) and other variations.

While positive currents have been described, currents may be negative or positive, as electrons or holes may be considered the carrier in some cases. Charging and discharging may be interchangeable terms when referring to carriers of opposite polarity. Currents may flow in the reverse direction.

The generated power supply Vout may be less than 2.0 volts, such as 1.8 volts, 1.5 volts, 1.2 volts, or 1.0 volts, rather than the 2.6-3.7 volts shown in FIG. 5. The input power voltage Vin may be a volt or so higher, such as 5 volts for FIG. 5, or 3 volts for lower generated voltages.

While the term "bandgap" has been used, this is something of a misnomer, since the base-emitter voltage of the PNP transistor provides the reference voltage, rather than a bandgap. However, the term bandgap is nevertheless widely used for these circuits.

The background of the invention section may contain background information about the problem or environment of the invention rather than describe prior art by others. Thus inclusion of material in the background section is not an admission of prior art by the Applicant.

Any methods or processes described herein are machine-implemented or computer-implemented and are intended to be performed by machine, computer, or other device and are not intended to be performed solely by humans without such machine assistance. Tangible results generated may include reports or other machine-generated displays on display devices such as computer monitors, projection devices, audio-generating devices, and related media devices, and may include hardcopy printouts that are also machine-generated. Computer control of other machines is another a tangible result.

Any advantages and benefits described may not apply to all embodiments of the invention. When the word "means" is recited in a claim element, Applicant intends for the claim element to fall under 35 USC Sect. 112, paragraph 6. Often a label of one or more words precedes the word "means". The word or words preceding the word "means" is a label intended to ease referencing of claim elements and is not intended to convey a structural limitation. Such means-plus-function claims are intended to cover not only the structures described herein for performing the function and their structural equivalents, but also equivalent structures. For example, although a nail and a screw have different structures, they are equivalent structures since they both perform the function of fastening. Claims that do not use the word "means" are not intended to fall under 35 USC Sect. 112, paragraph 6. Signals are typically electronic signals, but may be optical signals such as can be carried over a fiber optic line.

The foregoing description of the embodiments of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

We claim:

1. A programmable voltage regulator comprising:

a voltage input;

a regulated voltage output a regulator transistor having a channel between the voltage input and the regulated voltage output, wherein an effective resistance of the channel is a function of a gate voltage of the regulator transistor;

a reference voltage generator for generating a reference voltage;

a comparator receiving the reference voltage from the reference voltage generator and a feedback voltage, the comparator comparing the feedback voltage to the reference voltage to generate the gate voltage to the regulator transistor;

a variable resistor network coupled between the regulated voltage output and a ground;

a series of resistors within the variable resistor network;

a plurality of switches coupled to tap nodes between resistors in the series of resistors, the plurality of switches connecting a tap node to the comparator to generate the feedback voltage; and a programmable register storing a resistor setting value that controls the plurality of switches, the resistor setting value determining which tap node in the series of resistors is connected to the comparator as the feedback voltage.

2. The programmable voltage regulator of claim 1 wherein the variable resistor network further comprises:

an upper select network, coupled between the regulated voltage output and an upper node, the upper select network having a selectable upper resistance determined by the resistor setting value in the programmable register;

a lower select network, coupled between the ground and a lower node, the lower select network having a selectable lower resistance determined by the resistor setting value in the programmable register;

wherein the series of resistors is coupled between the upper node and the lower node.

3. The programmable voltage regulator of claim 2 wherein the upper select network comprises:

a plurality of upper select transistors having gates controlled by upper control signals generated from the programmable register;

a plurality of upper resistors, each upper resistor being in series with an upper select transistor in the plurality of upper select transistors;

wherein a selected upper resistor in the plurality of upper resistors is selected when the upper select transistor in series with the selected upper resistor is enabled by the programmable register, wherein the selected upper resistor is enabled to conduct current between the regulated voltage output and the upper node.

4. The programmable voltage regulator of claim 3 wherein the lower select network comprises:

a plurality of lower select transistors having gates controlled by lower control signals generated from the programmable register;

a plurality of lower resistors, each lower resistor being in series with a lower select transistor in the plurality of lower select transistors;

wherein a selected lower resistor in the plurality of lower resistors is selected when the lower select transistor in series with the selected lower resistor is enabled by the programmable register, wherein the selected lower resistor is enabled to conduct current between the lower node and the ground.

5. The programmable voltage regulator of claim 4 wherein upper resistors in the plurality of upper resistors each have different resistance values;

wherein a plurality of differing selectable upper resistances between the regulated voltage output and the upper node are selectable by the programmable register;

wherein lower resistors in the plurality of lower resistors each have different resistance values;

wherein a plurality of differing selectable lower resistances between the lower node and the ground are selectable by the programmable register.

6. The programmable voltage regulator of claim 5 wherein resistors in the series of resistors have equal resistance values.

7. The programmable voltage regulator of claim 6 wherein the regulator transistor is a p-channel transistor in a low-dropout (LDO) regulator.

8. The programmable voltage regulator of claim 6 wherein the regulator transistor is an n-channel source-follower transistor.

9. The programmable voltage regulator of claim 4 wherein the plurality of upper select transistors comprise p-channel transistors;

wherein the plurality of lower select transistors comprise n-channel transistors.

10. The programmable voltage regulator of claim 4 further comprising:

a coarse decoder for decoding a first portion of the resistor setting value in the programmable register to generate the upper control signals and the lower control signals.

11. The programmable voltage regulator of claim 10 wherein the upper control signals are logical inverses of the lower control signals.

12. The programmable voltage regulator of claim 10 further comprising:

a fine decoder for decoding a second portion of the resistor setting value in the programmable register to generate switch control signals that control the plurality of switches coupled to tap nodes.

13. The programmable voltage regulator of claim 12 wherein increments in the first portion of the resistor setting value produce coarse voltage adjustments of the regulated voltage output;

wherein increments in the second portion of the resistor setting value produce fine voltage adjustments of the regulated voltage output;

wherein the coarse voltage adjustments are at least five times larger than the fine voltage adjustments.

14. The programmable voltage regulator of claim 4 wherein each switch in the plurality of switches comprises a n-channel transistor between a tap node and an input to the comparator that applies the feedback voltage to the comparator.

15. The programmable voltage regulator of claim 4 wherein each switch in the plurality of switches comprises a transmission gate having an n-channel transistor and a p-channel transistor in parallel between a tap node and an input to the comparator that applies the feedback voltage to the comparator.

16. The programmable voltage regulator of claim 4 wherein the comparator is an operational amplifier.

17. The programmable voltage regulator of claim 4 wherein the plurality of switches comprises at least four switches for selecting the feedback voltage from among at least four tap nodes;

wherein the plurality of upper select transistors comprises at least four transistors for selecting from among at least four selectable upper resistances;

wherein the programmable register stores the resistor setting value that selects from at least 16 combinations of the tap nodes and the selectable upper resistances.

18. The programmable voltage regulator of claim 4 wherein the programmable register stores the resistor setting value that selects two adjacent tap nodes for simultaneous connection to the comparator;

wherein the feedback voltage is interpolated from between the two adjacent tap nodes selected, whereby the feedback voltage is interpolated from two adjacent tap nodes selected and simultaneously connected to the comparator.

19. The programmable voltage regulator of claim 4 wherein the regulated voltage output drives analog circuits on a mixed-signal integrated circuit chip as an analog power supply voltage AVDD.

20. The programmable voltage regulator of claim 19 wherein the programmable registers are programmable with the resistor setting value by digital circuits on the mixed-signal integrated circuit chip in response to execution of software instructions.

21. A voltage regulator circuit comprising:

an input voltage;

an output voltage;

a reference voltage generated by a reference circuit to be relatively independent of variations in the input voltage and the output voltage;

a feedback voltage on a feedback node, the feedback voltage being generated from the output voltage;

an op amp that receives the reference voltage on a first input and receives the feedback voltage on a second input, and generates a gate voltage as a function of a difference between the feedback voltage and the reference voltage;

a regulator transistor having a gate receiving the gate voltage from the op amp, an input terminal receiving the input voltage, and an output terminal generating the output voltage, wherein the input terminal and the output terminal are source/drain terminals;

a register;

an upper variable-resistance network coupled between the output voltage and an upper node, the upper variable-resistance network having an upper resistance selected by the register;

a lower variable-resistance network coupled between a lower node and a ground, the lower variable-resistance network having a lower resistance selected by the register;

a series of resistors connected between the upper node and the lower node;

a plurality of switches, controlled by the register, the plurality of switches selectably connecting tap nodes within the series of resistors to the first input of the op amp in response to the register;

wherein the upper variable-resistance network, the series of resistors, and the lower variable-resistance network form a voltage divider that generates the feedback voltage from the output voltage;

wherein the register selects resistance values in the voltage divider to set the output voltage.

22. A programmable voltage regulator comprising:

a voltage input;

a regulated voltage output regulator transistor means for conducting a current in a channel between the voltage input and the regulated voltage output, wherein the current is a function of a gate voltage of the regulator transistor means;

reference voltage generator means for generating a reference voltage;

op amp means, receiving the reference voltage from the reference voltage generator means and receiving a feedback voltage, for comparing the feedback voltage to the reference voltage to generate the gate voltage to the regulator transistor means;

a series of resistors;

a plurality of switches coupled to tap nodes between resistors in the series of resistors, the plurality of switches connecting a tap node to the op amp means to generate the feedback voltage;

programmable register means for storing a resistor setting value that controls the plurality of switches, the resistor setting value determining which tap node in the series of resistors is connected to the op amp means as the feedback voltage;

upper select network means, coupled between the regulated voltage output and an upper node, for generating a selectable upper resistance determined by the resistor setting value in the programmable register means; and lower select network means, coupled between a ground and a lower node, for generating a selectable lower resistance determined by the resistor setting value in the programmable register means;

wherein the series of resistors is coupled between the upper node and the lower node.

* * * * *